US010118279B2

(12) United States Patent
Hu

(10) Patent No.: US 10,118,279 B2
(45) **Date of Patent: *Nov. 6, 2018**

(54) RATCHET WRENCH WITH DUSTPROOF STRUCTURE

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 245 days.

This patent is subject to a terminal disclaimer.

(21) Appl. No.: 14/979,419

(22) Filed: Dec. 27, 2015

(65) Prior Publication Data

US 2016/0129563 A1 May 12, 2016

Related U.S. Application Data

(63) Continuation-in-part of application No. 13/712,102, filed on Dec. 12, 2012, now Pat. No. 9,254,557.

(30) Foreign Application Priority Data

Aug. 28, 2012 (TW) ..... 101131137 A

(51) Int. Cl.
*B25B 13/46* (2006.01)

(52) U.S. Cl.
CPC ..... *B25B 13/463* (2013.01)

(58) Field of Classification Search
CPC . B25B 13/463; B25B 23/0035; B25B 13/465; B25B 13/46; B25B 15/04
See application file for complete search history.

(56) References Cited

U.S. PATENT DOCUMENTS

| | | | | |
|---|---|---|---|---|
| 4,211,127 | A | 7/1980 | D'Oporto et al. | |
| 5,916,339 | A * | 6/1999 | Dumont | B25B 13/465 192/43.2 |
| 5,921,158 | A | 7/1999 | Slusar et al. | |
| 6,260,448 | B1 | 7/2001 | Chaconas | |
| 7,114,415 | B1 | 10/2006 | Chiang | |
| 7,311,019 | B2 | 12/2007 | Arnold et al. | |
| 9,254,557 | B2 * | 2/2016 | Hu | B25B 13/463 |

* cited by examiner

*Primary Examiner* — Robert Scruggs
(74) *Attorney, Agent, or Firm* — Alan D. Kamrath; Kamrath IP Lawfirm, P.A.

(57) ABSTRACT

A ratchet wrench includes a driving device. A compartment extends through the driving device. A drive member is received in the compartment. A ledge is formed on an inner periphery of an end of the compartment. A pressing rod extends into the drive member via the end of the compartment. The pressing rod is movable relative to the drive member along a rotating axis between a first position and a second position to control engagement with or detachment from a tool. A dustproof ring is mounted between the ledge and the pressing rod. The dustproof ring includes an outer side pressing against an abutment portion of the ledge and an inner side-pressing against the pressing rod wherever the pressing rod is in the first position and the second position.

8 Claims, 7 Drawing Sheets

RATCHET WRENCH WITH DUSTPROOF STRUCTURE

The present application is a continuation-in-part application of U.S. patent application Ser. No. 13/712,102, filed on Dec. 12, 2012, now U.S. Pat. No. 9,254,557, of which the entire disclosure is incorporated herein.

BACKGROUND OF THE INVENTION

The present invention relates to a ratchet wrench with a dustproof structure and, more particularly, to a ratchet wrench including a dustproof ring mounted between a head and a pressing rod for providing a dustproof effect.

U.S. Pat. No. 7,311,019 discloses a ratchet wrench including a head and a handle connected to the head. The head includes top and bottom ends, with a through cavity formed in the head from the top end to the bottom end. A ratchet gear is disposed in the through cavity. A cover plate is mounted to the bottom end of the head, and a ledge is formed on the top end of the head, preventing the ratchet gear from disengaging from the head. The ratchet gear includes a hole receiving a pressing rod operable to control engagement with or disengagement from a socket or the like. An O-ring is mounted between the top end of the head and the ratchet gear, and another O-ring is mounted between the bottom end of the head and the ratchet gear, preventing or reducing ingress of dirt into a space between the head and the ratchet gear.

However, dirt can enter a gap between the pressing rod and the ratchet gear, impeding movement of the pressing rod relative to the ratchet gear. Thus, the pressing rod cannot be operated to control engagement/disengagement of the socket after an amount of dirt is accumulated in the gap between the pressing rod and the ratchet gear, damaging the ratchet wrench.

Thus, a need exists for a ratchet wrench with a novel dustproof structure preventing ingress of dirt into the gap between the pressing rod and the ratchet gear.

BRIEF SUMMARY OF THE INVENTION

The present invention solves this need and other problems in the field of dustproof ratchet wrenches by providing a ratchet wrench including a driving device having first and second sides spaced along a rotating axis. A compartment extends from the first side through the second side. The driving device further includes a drive member received in the compartment and rotatable about the rotating axis. The drive member includes an end, with the end of the drive member adapted to drive a tool. A ledge is formed on an inner periphery of an end of the compartment at the second side. The ledge includes an abutment portion. A pressing rod extends into the drive member via the end of the compartment at the second side. The pressing rod is movable relative to the drive member along the rotating axis to control engagement with or detachment from the tool. A dustproof ring is mounted between the ledge and the pressing rod. The dustproof ring includes an outer side and an inner side surrounded by the outer side and spaced from the outer side in a radial direction perpendicular to the rotating axis. The outer side presses against the abutment portion of the ledge. The inner side presses against the pressing rod.

In preferred forms, the outer side includes an outer periphery pressing against the abutment portion of the ledge. The inner side includes an inner periphery spaced from the outer periphery in the radial direction perpendicular to the rotating axis. The inner periphery includes a lip having an outer surface pressing against the pressing rod. The dustproof ring further includes a flange having an outer diameter perpendicular to the rotating axis. The abutment portion of the ledge is an annular face surrounding the rotating axis and having an inner diameter perpendicular to the rotating axis. The inner diameter of the abutment portion is smaller than the outer diameter of the flange, preventing the dustproof ring from disengaging from the drive member by moving the dustproof ring away from the first side along the rotating axis.

The lip extends from the inner periphery towards the second side. The lip further has an inner surface located between the outer surface and the inner periphery. A receiving space is defined between the inner periphery and the inner surface of the lip. The receiving space is adapted to receive dirt stopped by the dustproof ring.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
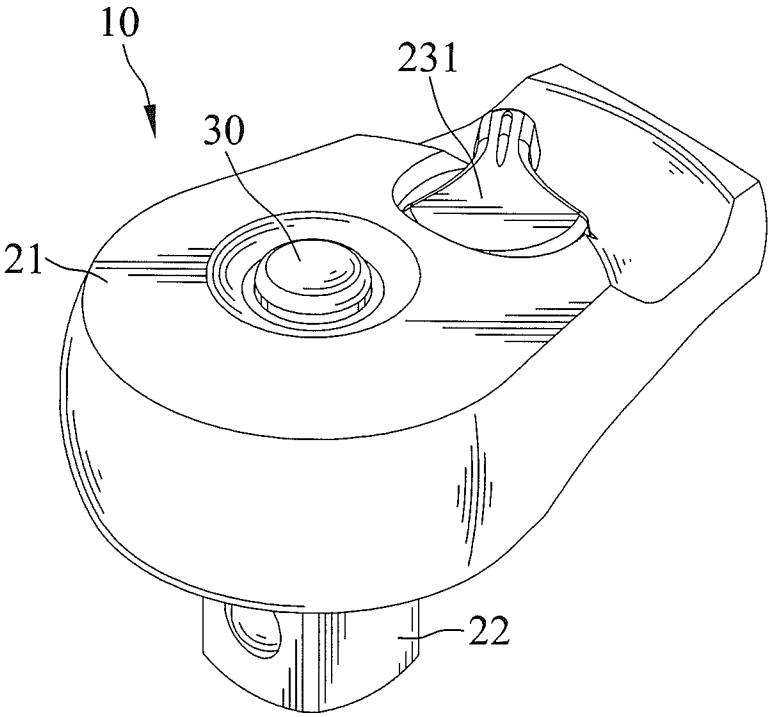
FIG. 1 shows a perspective view of a ratchet wrench with a dustproof structure of a first embodiment according to the present invention.

All figures are drawn for ease of explanation of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "section", "axial", "radial", "annular", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
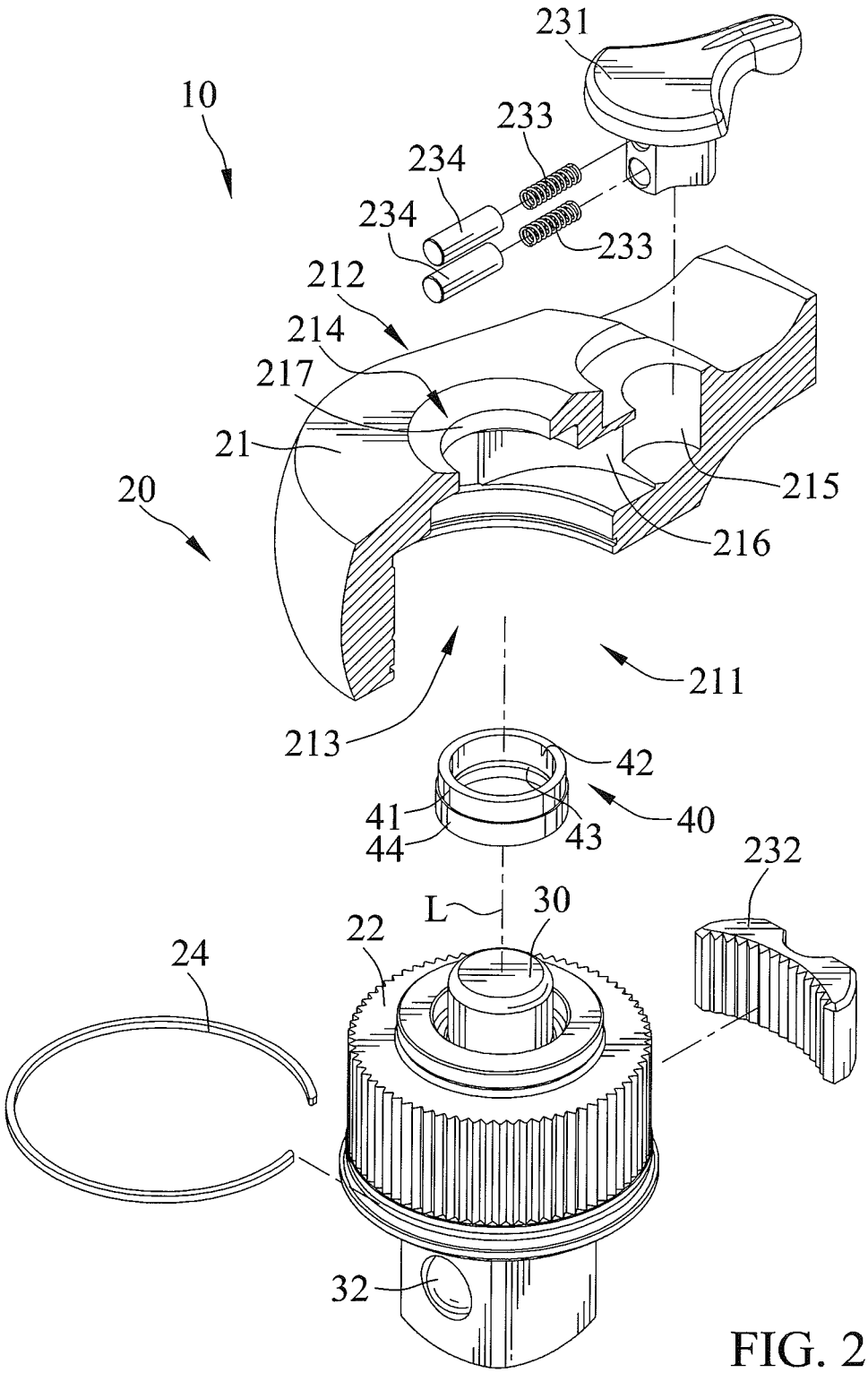
FIG. 2 shows an exploded, perspective view of the ratchet wrench of FIG. 1.
Figure 3:
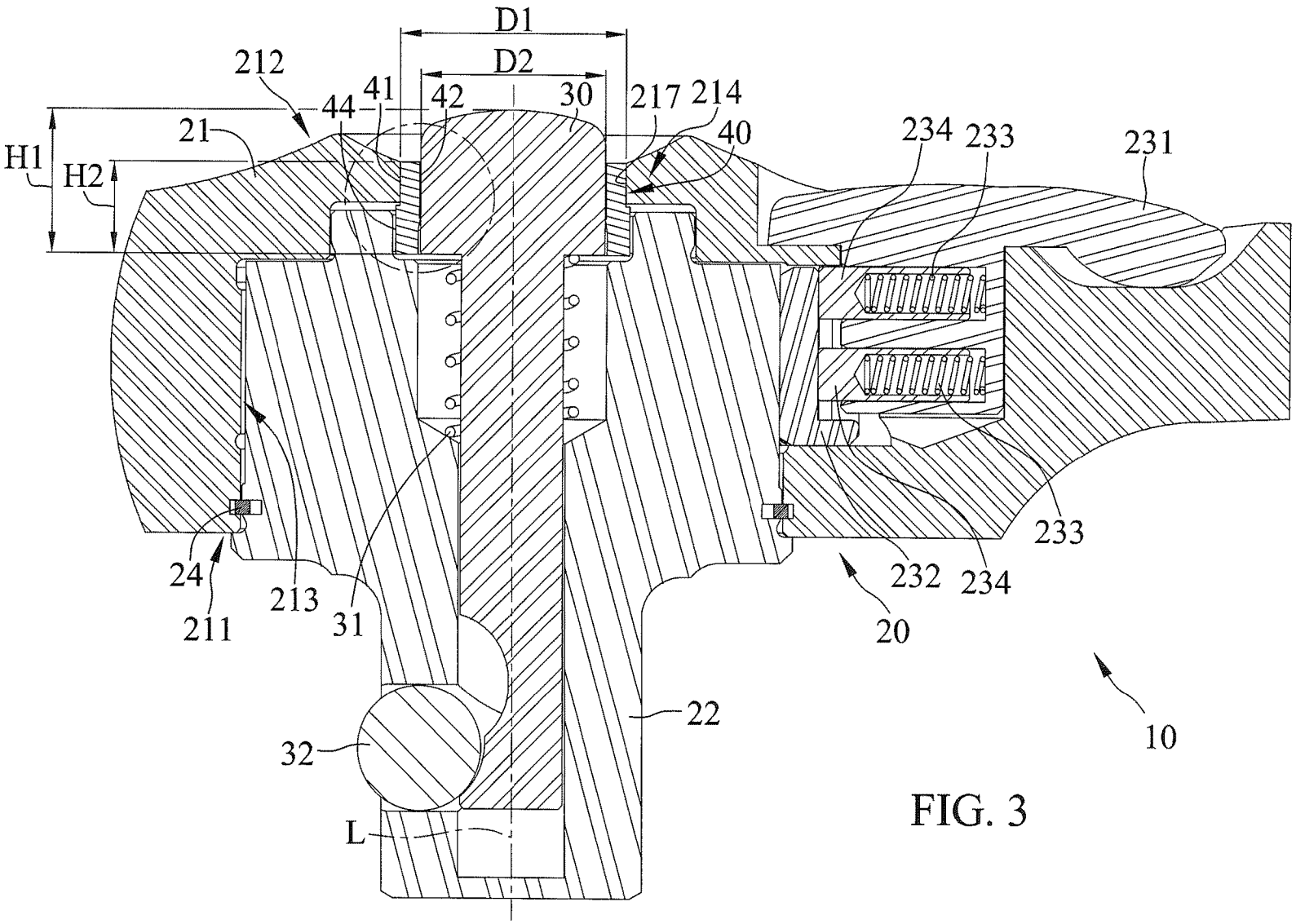
FIG. 3 shows a cross sectional view of the ratchet wrench of FIG. 1, with a pressing rod in a first position.

FIGS. 1-3 are a perspective view, an exploded view, and a cross sectional view of a ratchet wrench with a dustproof structure according to the present invention, respectively. Ratchet wrench 10 includes a driving device 20, a pressing rod 30, and a dustproof ring 40.

Driving device 20 includes a head 21 including first and second sides 211 and 212 spaced along a rotating axis L. Head 21 further includes a compartment 213 extending from first side 211 through second side 212. Compartment 213 is circular in cross section. A drive member 22 is received in compartment 213 and rotatable about rotating axis L. An end of drive member 22 is adapted to drive a tool, such as a socket. Compartment 213 includes a first face abutting with a second face of drive member 22 opposite to the end of the drive member 22. Second side 212 is axially spaced from the first face of compartment 213 opposite to the end of drive member 22. Drive member 22 includes an annular protrusion extending axially from the second face and opposite to the end of drive member 22 past the first face. A ledge 214 is formed on an inner periphery of an end of compartment 213 at second side 212. Ledge 214 includes an abutment portion 217 in the form shown as an annular face surrounding a rotating axis L. Abutment portion 217 of ledge 214 has a first diameter D1 perpendicular to rotating axis L. Driving device 20 can be manually operated to rotate about rotating axis L. A handle can be removably attached to or integrally formed with head 21.

A control groove 215 is formed in second side 212 of head 21. Head 21 further includes a pawl groove 216 in communication with compartment 213 and control groove 215. Pawl groove 216 is crescent in cross section. A pawl 232 is slideably received in pawl groove 216. A control member 231 is pivotably received in control groove 215. At least one elastic member 233 and at least one pressing member 234 are mounted between control member 231 and pawl 232. Control member 231 is operable to move pawl 232, controlling an engagement relation between drive member 22 and pawl 232 through the at least one elastic member 233 and the at least one pressing member 234. Thus, head 21 can selectively drive the drive member 22 to rotate in either of a clockwise direction and a counterclockwise direction. In this embodiment, two elastic members 233 and two pressing members 234 are provided to assure reliable engagement between pawl 232 and drive member 22.

A retaining ring 24 is mounted between head 21 and drive member 22 and located at the other end of compartment 213 adjacent to first side 211. Retaining ring 24 abuts head 21 and drive member 22, preventing drive member 22 from disengaging from head 21 via first side 211.

Figure 6:
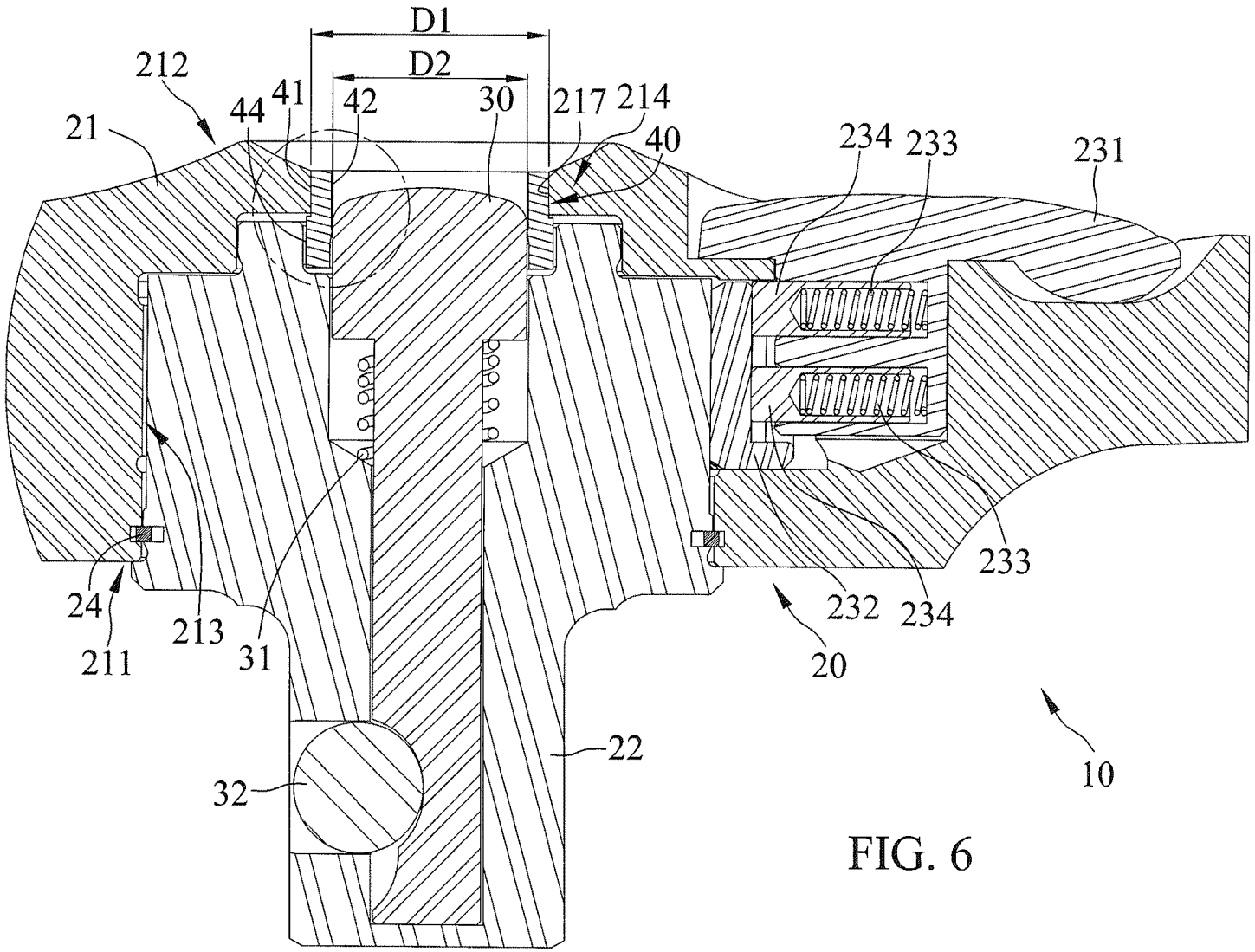
FIG. 6 shows another cross sectional view of the ratchet wrench of FIG. 1, with the pressing rod in a second position.

Pressing rod 30 extends into drive member 22 via the end of compartment 213 at second side 212. Pressing rod 30 is movable relative to drive member 22 along rotating axis L between a first position and a second position to control engagement with or detachment from the tool. As shown in FIG. 3, pressing rod 30 is arranged in the first position, and as shown in FIG. 6, pressing rod 30 is arranged in the second position. A head end of pressing rod 30 received in ledge 214 has a second diameter D2 perpendicular to rotating axis L. Moreover, the head end of pressing rod 30 has a first height H1 parallel to rotating axis L.

Dustproof ring 40 is made of an elastomeric material and mounted between ledge 214 and pressing rod 30. Dustproof ring 40 presses against abutment portion 217 and pressing rod 30, preventing dirt, sand, or other alien objects from entering an interior of head 21 via the end of compartment 213 at second side 212. Thus, driving device 20 can operate smoothly even in a dirty environment. Moreover, dustproof ring 40 has a second height H2 parallel to rotating axis L and greater than half of first height H1. A spring 31 is mounted between pressing rod 30 and drive member 22. Specifically, spring 31 is mounted around pressing rod 30. A ball 32 is mounted to the other end of pressing rod 30 adjacent to first side 211. Ball 32 is located between pressing rod 30 and drive member 22. A user can press pressing rod 30 to control movement of ball 32 between the first position and the second position, controlling engagement with or detachment from the tool. Spring 31 provides pressing rod 30 with a returning function and biases pressing rod 30 from the second position to the first position in which drive member 22 is engaged with the tool.

Figure 4:
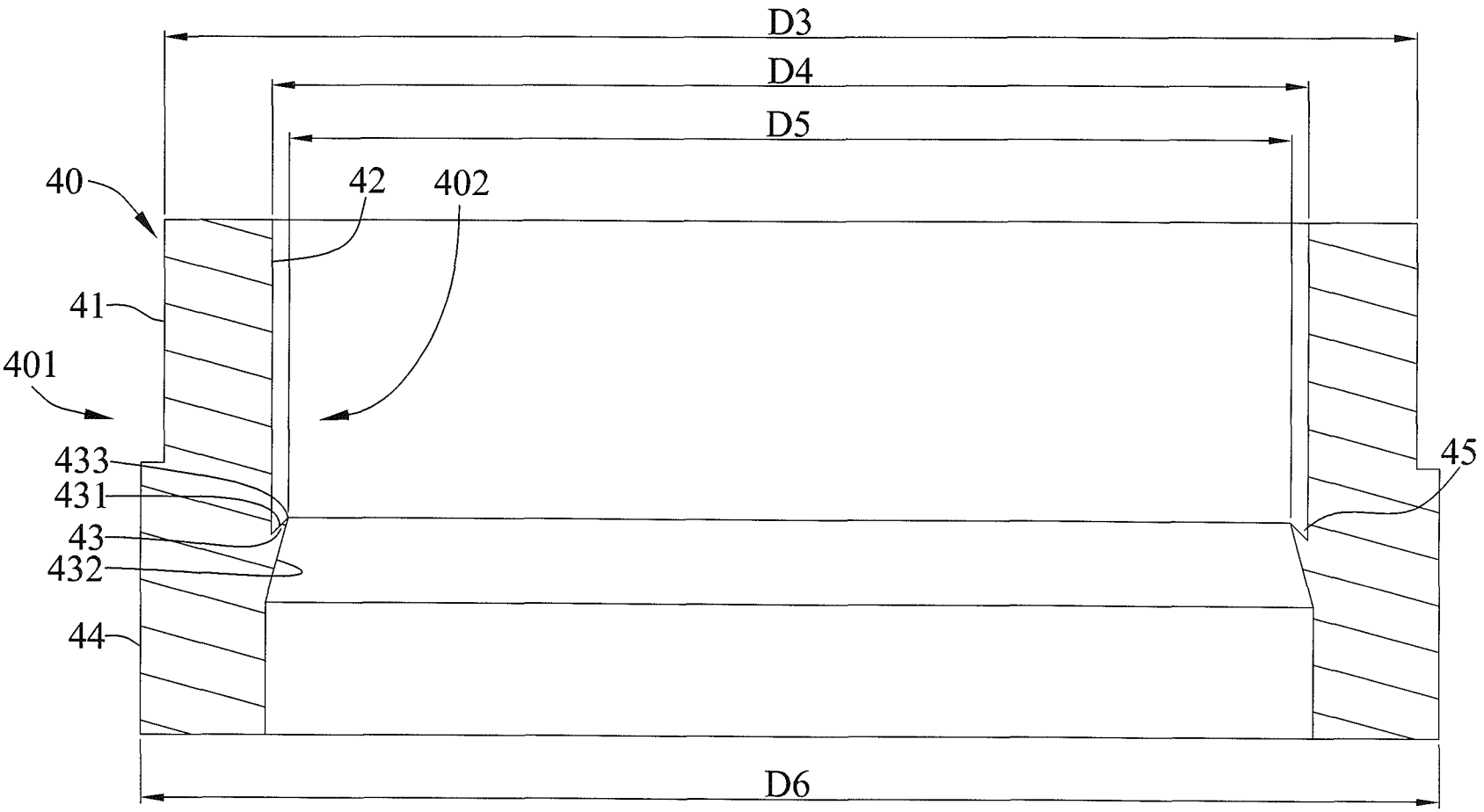
FIG. 4 shows a cross sectional view of a dustproof ring of the ratchet wrench of FIG. 1, with the dustproof ring in an uncompressed state.

FIG. 4 is a cross sectional view of dustproof ring 40 in an uncompressed state. Dustproof ring 40 in the uncompressed state is annular and rectangular in cross section. Dustproof ring 40 includes an outer side 401 and an inner side 402 surrounded by outer side 401 and spaced from outer side 401 in a radial direction perpendicular to rotating axis L, with outer side 401 pressing against abutment portion 217 of ledge 214, with inner side 402 pressing against pressing rod 30. More specifically, outer side 401 includes an outer periphery 41 pressing against abutment portion 217 of ledge 214. Outer periphery 41 of dustproof ring 40 in the uncompressed state has a third diameter D3 perpendicular to rotating axis L. Inner side 402 includes an inner periphery 42 spaced from outer periphery 41 in the radial direction perpendicular to rotating axis L. Inner periphery 42 is adjacent to pressing rod 30. Inner periphery 42 of dustproof ring 40 in the uncompressed state has a fourth diameter D4 perpendicular to rotating axis L.

Furthermore, a lip 43 extends from inner periphery 42 towards second side 212. Lip 43 includes an outer surface 432 pressing against pressing rod 30. Lip 43 further includes an inner surface 431 located between outer surface 432 and inner periphery 42. Lip 43 further includes a tip 433 between inner and outer surfaces 431 and 432. Tip 433 is annular and has a fifth diameter D5 perpendicular to rotating axis L. A receiving space 45 is defined between inner periphery 42 and inner surface 431 of lip 43. Receiving space 45 is adapted to receive dirt stopped by dustproof ring 40.

Third diameter D3 is larger than first diameter D1, such that dustproof ring 40 is in tight coupling with abutment portion 217 of ledge 214. Fourth diameter D4 is larger than second diameter D2, such that pressing rod 30 can move smoothly relative to drive member 22 along rotating axis L between the first position and the second position. Fifth diameter D5 is smaller than second diameter D2, such that lip 43 of dustproof ring 40 is in tight coupling with an outer periphery of head end of pressing rod 30, preventing dirt from entering an interior of driving device 20 from between pressing rod 30 and dustproof ring 40.

Dustproof ring 40 further includes a flange 44 having a sixth diameter D6 perpendicular to rotating axis L. Sixth diameter D6 is larger than third diameter D3, such that flange 44 abuts against and is stopped by ledge 214 when dustproof ring 40 is moved away from first side 211 along rotating axis L, preventing dustproof ring 40 from disengaging from drive member 22 by moving dustproof ring 40 away from first side 211 along rotating axis L.

Figure 5:
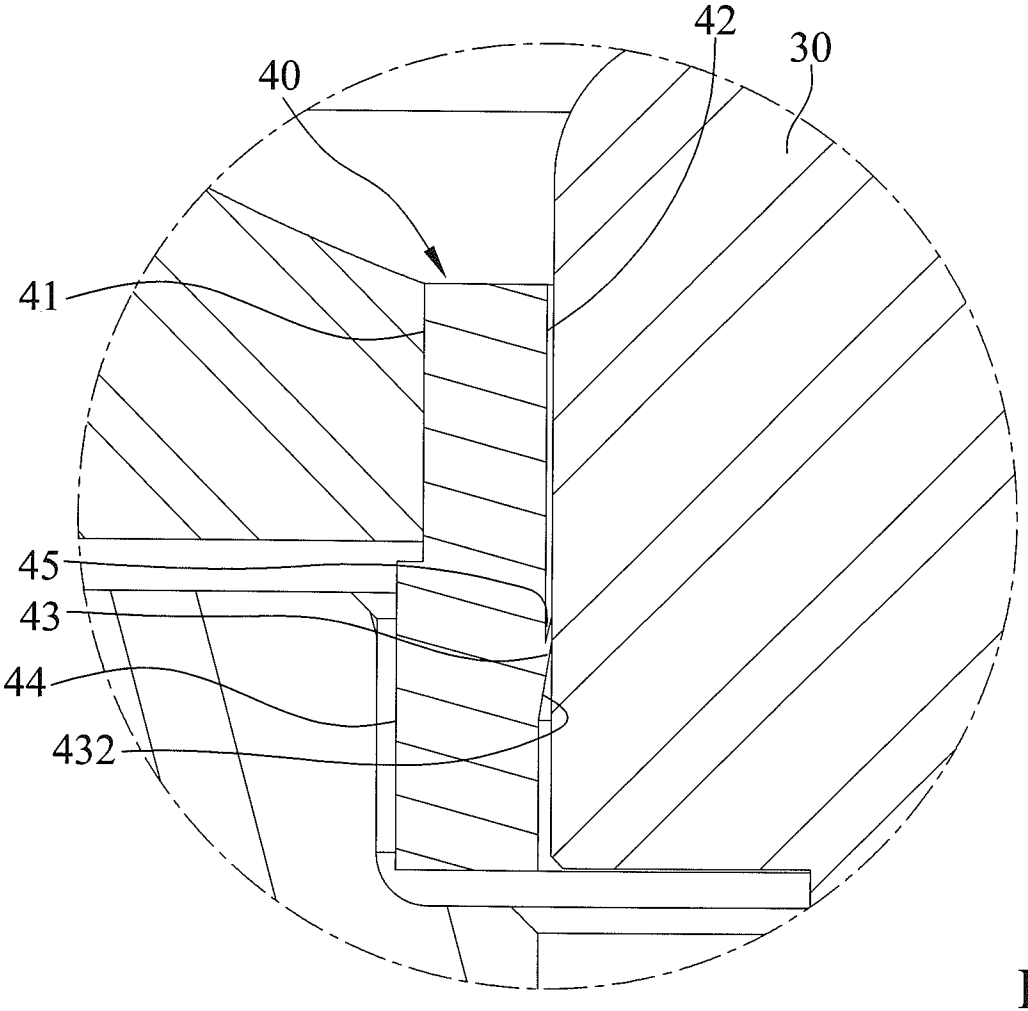
FIG. 5 shows an enlarged view of a circled portion of FIG. 3.

FIG. 5 shows an enlarged view of a circled portion of FIG. 3. Dustproof ring 40 made of elastomeric material is in tight coupling with abutment portion 217 of ledge 214. Furthermore, lip 43 deforms while in tight coupling with the outer periphery of the head end of pressing rod 30. Specifically, lip 43 bends towards outer side 401, and outer surface 432 presses against the outer periphery of the head end of pressing rod 30, providing an enhanced dustproof effect. When dirt is adhered to pressing rod 30 or enters a gap between pressing rod 30 and inner periphery 42, inner surface 431 of lip 43 scrapes dirt adhered to the outer periphery of the head end of pressing rod 30. The dirt falls into and is retained in receiving space 45, preventing dirt from entering the interior of ratchet wrench 10. Thus, driving device 20 can operate smoothly by preventing dirt from entering the gap between head 21 and drive member 22. Furthermore, dirt is also prevented from entering the gap between the outer periphery of the head end of pressing rod 30 and drive member 22, allowing the user to easily mount the tool to drive member 22.

Figure 7:
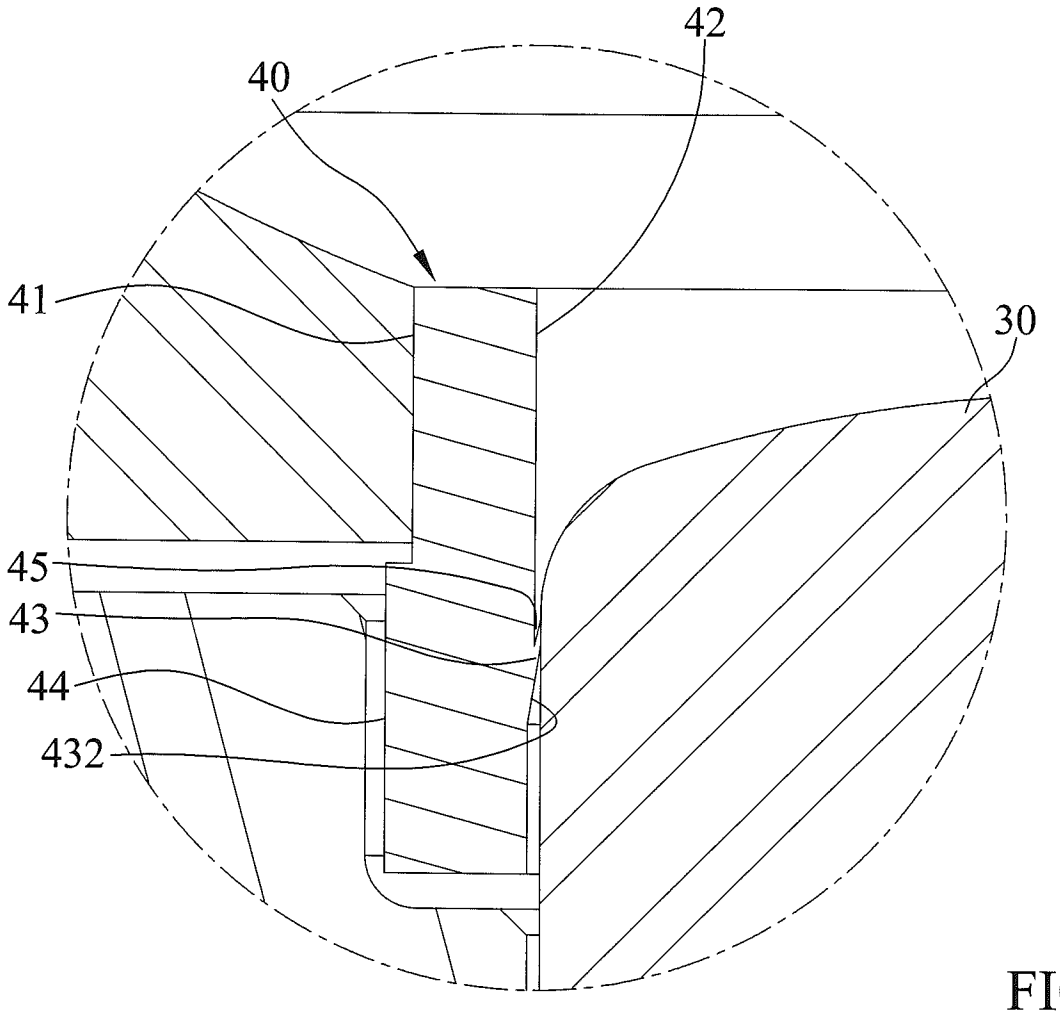
FIG. 7 shows an enlarged view of a circled portion of FIG. 6.

FIGS. 6 and 7 show the pressing rod 30 in the second position. Pressing rod 30 is moved relative to drive member 22 along rotating axis L from the first position to the second position, when the user presses a top of the head end of pressing rod 30. At this point, ball 32 is completely sunk into drive member 22, enabling the tool adapted to be detached from drive member 22. Moreover, outer surface 432 of lip 43 still presses against the outer periphery of the head end of pressing rod 30, providing an enhanced dustproof effect. Furthermore, dirt is also prevented from entering the gap between the outer periphery of the head end of pressing rod 30 and drive member 22, allowing the user to easily detach the tool from drive member 22.

In conclusion, ratchet wrench 10 according to the present invention provides the following advantages:

1. Dustproof ring 40 mounted between driving device 20 and the outer periphery of the head end of pressing rod 30 prevents dirt from entering the gap between head 21 and drive member 22 whether pressing rod 30 is in the first position or in the second position, assuring smooth operation of driving device 20. Furthermore, dirt cannot enter the gap between the outer periphery of the head end of pressing rod 30 and drive member 22, allowing the user to easily mount the tool to or detach the tool from the drive member 22.

2. Dustproof ring 40 made of elastomeric material deforms to an extent responsive to external conditions, such that dustproof ring 40 can be in tight coupling with abutment portion 217 of ledge 214. Furthermore, lip 43 deforms while in tight coupling with the outer periphery of the head end of pressing rod 30. Lip 43 bends towards outer side 401, and outer surface 432 presses against the outer periphery of the head end of pressing rod 30 whether pressing rod 30 is in the first position or in the second position, providing enhanced dustproof effect. Inner surface 431 of lip 43 scrapes dirt adhered to the outer periphery of the head end of pressing rod 30 or entering the gap between the outer periphery of the head end of pressing rod 30 and inner periphery 42, preventing dirt from entering the interior of ratchet wrench 10.

3. Dustproof ring 40 provides receiving space 45. The dirt falls into receiving space 45 along inner surface 431 and is retained in receiving space 45, effectively preventing dirt from entering the interior of ratchet wrench 10.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising:

a driving device including first and second sides spaced along a rotating axis, with a compartment extending from the first side through the second side, with the driving device further including a drive member received in the compartment and rotatable about the rotating axis, with the drive member including an end, with the end of the drive member adapted to drive a tool, with a ledge formed on an inner periphery of an end of the compartment at the second side, with the ledge including an abutment portion of an annular shape;

a pressing rod extending into the drive member via the abutment portion and the end of the compartment at the second side, with the pressing rod movable relative to the drive member along the rotating axis between a first position and a second position to control engagement with or detachment from the tool; and a dustproof ring mounted between the ledge and the pressing rod, with the dustproof ring including an outer side and an inner side surrounded by the outer side and spaced from the outer side in a radial direction perpendicular to the rotating axis, with the outer side pressing against the abutment portion of the ledge, with the inner side including a lip pressing against the pressing rod wherever the pressing rod is in the first position and the second position.

2. The ratchet wrench as claimed in claim 1, with the outer side of the dustproof ring including an outer periphery pressing against the abutment portion of the ledge, with the inner side including an inner periphery spaced from the outer periphery in the radial direction perpendicular to the rotating axis, and with the inner periphery including the lip having an outer surface pressing against a head end of the pressing rod.

3. The ratchet wrench as claimed in claim 2, with the lip extending from the inner periphery towards the second side, with the lip further having an inner surface located between the outer surface and the inner periphery, with a receiving space defined between the inner periphery and the inner surface of the lip, and with the receiving space adapted to receive dirt stopped by the dustproof ring.

4. The ratchet wrench as claimed in claim 2, with the abutment portion of the ledge being an annular face surrounding the rotating axis and having a first diameter perpendicular to the rotating axis, with the head end of the pressing rod received in the ledge and having a second diameter perpendicular to the rotating axis, with the outer periphery of the dustproof ring in an uncompressed state having a third diameter perpendicular to the rotating axis, with the inner periphery of the dustproof ring in the uncompressed state having a fourth diameter perpendicular to the rotating axis, with the lip further including a tip between the inner and outer surfaces, with the tip being annular and having a fifth diameter perpendicular to the rotating axis, with the third diameter larger than the first diameter, with the fourth diameter larger than the second diameter, and with the fifth diameter smaller than the second diameter.

5. The ratchet wrench as claimed in claim 2, with the head end of pressing rod having a first height parallel to the rotating axis, and with the dustproof ring having a second height parallel to rotating axis and greater than half of the first height.

6. The ratchet wrench as claimed in claim 1, with the compartment including a first face abutting with a second face of the drive member opposite to the end of the drive member, with the second side axially spaced from the first face of the compartment opposite to the end of the drive member, with the drive member including an annular protrusion extending axially from the second face and opposite to the end of the drive member past the first face.

7. The ratchet wrench as claimed in claim 6, with the dustproof ring including a flange having an outer diameter perpendicular to the rotating axis, with the abutment portion of the ledge being an annular face surrounding the rotating axis and having an inner diameter perpendicular to the rotating axis, with the inner diameter of the abutment portion smaller than the outer diameter of the flange, preventing the dustproof ring from disengaging from the drive member by moving the dustproof ring away from the first side along the rotating axis.

8. The ratchet wrench as claimed in claim 6, with the driving device including a head having the first and second sides, with a control groove formed in the second side of the head, with the head including a pawl groove in communication with the compartment and the control groove, with a pawl slideably received in the pawl groove, with a control member pivotably received in the control groove, with an elastic member and a pressing member mounted between the control member and the pawl, with the control member operable to move the pawl to engage with the drive member, allowing the head to selectively drive the drive member in either of a clockwise direction and a counterclockwise direction.

* * * * *